US006654716B2

(12) United States Patent
Bruhn et al.

(10) Patent No.: US 6,654,716 B2
(45) Date of Patent: Nov. 25, 2003

(54) PERCEPTUALLY IMPROVED ENHANCEMENT OF ENCODED ACOUSTIC SIGNALS

(75) Inventors: Stefan Bruhn, Sollentuna (SE); Susanne Olvenstam, Kista (SE)

(73) Assignee: Telefonaktiebolaget LM Ericsson, Stockholm (SE)

( * ) Notice: Subject to any disclaimer, the term of this patent is extended or adjusted under 35 U.S.C. 154(b) by 98 days.

(21) Appl. No.: 09/982,029

(22) Filed: Oct. 19, 2001

(65) Prior Publication Data

US 2002/0049583 A1 Apr. 25, 2002

(30) Foreign Application Priority Data

Oct. 20, 2000 (EP) ..... 00850169

(51) Int. Cl.[7] ..... G10L 19/04; G10L 19/00; G10L 19/02; G10L 19/14

(52) U.S. Cl. ..... 703/219; 704/200.1; 704/203; 704/205; 704/206; 704/501; 704/230

(58) Field of Search ..... 704/200.1, 201, 704/205, 206, 219, 220, 221, 222, 225, 229, 230, 224, 500–504, 268, 265, 266, 264, 262; 375/240.13, 240.12

(56) References Cited

U.S. PATENT DOCUMENTS 4,811,398 A * 3/1989 Copperi et al. ..... 704/230
5,630,012 A 5/1997 Nishiguchi et al.
5,754,534 A 5/1998 Nahumi
5,832,427 A 11/1998 Shibuya
5,848,391 A * 12/1998 Bosi et al. ..... 704/200.1
RE36,714 E * 5/2000 Brandenburg et al. ..... 704/227
6,092,041 A * 7/2000 Pan et al. ..... 704/229
6,094,636 A * 7/2000 Kim ..... 704/500
6,108,625 A * 8/2000 Kim ..... 704/229
6,115,688 A * 9/2000 Brandenburg et al. ..... 704/503
6,182,030 B1 * 1/2001 Hagen et al. ..... 704/201
6,349,284 B1 * 2/2002 Park et al. ..... 704/500
6,370,502 B1 * 4/2002 Wu et al. ..... 704/230
6,496,795 B1 * 12/2002 Malvar ..... 704/203

FOREIGN PATENT DOCUMENTS

EP 0933757 A2 8/1999

OTHER PUBLICATIONS

Dinei A.F. Floréncio: "On The Use of Asymmetric Windows for Reducing The Time Delay in Real–Time Spectral Analysis"; Dept. of Electrical Engineering, Universidade de Brasilia, Brasil, pp. 3261–3264.

K. Brandenburg et al.: "First Ideas on Scalable Audio Coding"; Fraunhofer Gesellschaft, Institut for Integrated Circuits, Erlangen, Germany, pp. 1–6(B).

K. Koishida et al.: "A 16–KBIT/S Bandwidth Scalable Audio Coder Based On The G.729 Standard", Dept. of Electrical and Computer Engineering, University of California, Santa Barbara CA USA, pp. 1149–1152.

* cited by examiner

*Primary Examiner*—Vijay Chawan

(57) ABSTRACT

The invention relates to encoding of broadband and narrowband acoustic source signals (x) such that the perceived sound quality of corresponding reconstructed signals is improved in comparison to the known solutions. An enhancement estimation unit (102), operating in serial or in parallel with the regular encoding/decoding means (101), perceptually enhances a reconstructed acoustic source signal by utilization of an enhancement spectrum (C) comprising a larger number of spectral coefficients than the number of sample values in corresponding frames of the signals carrying the basic encoded representation of the acoustic source signal. The thus extended block length of the enhancement spectrum frame provides a basis for accomplishing the desired improvement of the perceived sound quality.

65 Claims, 4 Drawing Sheets

PERCEPTUALLY IMPROVED ENHANCEMENT OF ENCODED ACOUSTIC SIGNALS

THE BACKGROUND OF THE INVENTION AND PRIOR ART

The present invention relate generally to encoding of an acoustic source signal such that a corresponding signal reconstructed on basis of the encoded information has a perceived sound quality, which is higher than according to known encoding solutions. More particularly the invention relates to encoding of acoustic source signals to produce encoded information for transmission over a transmission medium.

There are many different applications for speech codecs (codec=coder and decoder). Encoding and decoding schemes are, for instance, used for bit-rate efficient transmission of acoustic source signals in fixed and mobile communications systems and in videoconferencing systems. Speech codecs can also be utilised in secure telephony and for voice storage.

The trend in fixed and mobile telephony as well as in videoconferencing is towards improved quality of the reconstructed acoustic source signal. This trend reflects the customer expectation that these systems provide a sound quality at least as good as that of today's fixed telephone network. One way to meet this expectation is to broaden the frequency band for the acoustic source signal and thus convey more of the information contained in the source signal to the receiver. It is true that the majority of the energy of a speech signal is spectrally located between 0 kHz and 4 kHz (i.e. the typical bandwidth of a state-of-the-art codec). However, a substantial amount of the energy is also distributed in the frequency band 4 kHz to 8 kHz. The frequency components in this band represent information that is perceived by a human listener as "clearness" and a feeling of the speaker "being close" to the listener.

The frequency resolution of the human hearing decreases with increasing frequencies. The frequency components between 4 kHz and 8 kHz therefore require comparatively few bits to model with a sufficient accuracy.

One approach to the problem of encoding an acoustic source signal such that it can be reconstructed by a receiver with a relatively good perceived sound quality is to include, for instance, a post filter operating in serial or in parallel with the regular encoding means, which generates an encoded signal in addition to the primary encoded information. Coding solutions involving post filtering exist for narrowband acoustic source signals (typically having a bandwidth of 0–3.5 kHz or 0–4 kHz). However, if these narrowband solutions are used for transmitting acoustic source signals with larger bandwidths, the signals are reconstructed with a comparatively poor sound quality. The reason for this is that both the basic coder solution and the enhancement solution are optimised for preserving the characteristics of narrowband signals. In fact, the enhancement coding can, under unfortunate circumstances, even worsen the situation with respect to perceived sound quality.

Moreover, the known speech codecs operating at rates below 16 kbps, typically in mobile applications, in general show a relatively low performance for non-speech sounds, such as music.

Thus, none of today's codecs or coding schemes provide a solution through which a broadband acoustic source signal can be encoded and reconstructed with a satisfying perceived quality. Furthermore, perceptually improved narrowband coding solutions are demanded for certain applications.

SUMMARY OF THE INVENTION

The object of the present invention is therefore to alleviate the above problems and make possible an efficient encoding, transmission and reconstruction of broadband and narrowband acoustic source signals having a substantially improved perceived quality in comparison to the known solutions.

According to one aspect of the invention the object is achieved by a method of encoding an acoustic source signal as initially described, which is characterised by an enhancement spectrum comprising a larger number of spectral coefficients than the number of sample values in a target signal frame respective a primary coded signal frame. The increased number of spectral coefficients in the enhancement spectrum in relation to the number of sample values in the other signals thus provides a basis for accomplishing the desired improvement of the perceived sound quality.

According to a further aspect of the invention the object is achieved by a computer program directly loadable into the internal memory of a computer, comprising software for controlling the method described in the above paragraph when said program is run on the computer.

According to another aspect of the invention the object is achieved by a computer readable medium, having a program recorded thereon, where the program is to make the computer control the method described in the penultimate paragraph above.

According to yet another aspect of the invention the object is achieved by a method of decoding encoded information having been transmitted over a transmission medium as initially described, which is characterised by producing an enhanced coded signal by extending a relevant reconstructed primary coded signal frame to comprise as many sample values as there are spectral coefficients in the enhancement spectrum.

According to still a further aspect of the invention the object is achieved by a computer program directly loadable into the internal memory of a computer, comprising software for controlling the method described in the above paragraph when said program is run on the computer.

According to an additional aspect of the invention the object is achieved by a computer readable medium, having a program recorded thereon, where the program is to make the computer control the method described in the penultimate paragraph above.

According to another aspect of the invention the object is achieved by a transmitter for encoding an acoustic source signal to produce encoded information for transmission over a transmission medium as initially described, which is characterised in that an enhancement spectrum comprises a larger number of spectral coefficients than there are sample values in an incoming target signal frame respective an incoming primary coded signal frame. An enhancement estimation unit in the transmitter extends a relevant target signal frame and a relevant primary coded signal frame such that they each comprise as many sample values as there are spectral coefficients in the enhancement spectrum.

According to yet another aspect of the invention the object is achieved by a receiver for receiving and decoding encoded information from a transmission medium as initially described, which is characterised in that an enhancement unit extends an incoming reconstructed primary coded signal frame to comprise as many sample values as there are spectral coefficients in the enhancement spectrum.

According to still another aspect of the invention the object is achieved by a communication system for the exchange of encoded acoustic source signals between a first and a second node comprising the proposed transmitter, the proposed receiver and a transmission medium for transporting encoded information from the transmitter to the receiver.

The proposed extended number spectral coefficients in the enhancement spectrum, of course, increases the frequency resolution for the corresponding signal. This provides a basis for many beneficial effects, particularly with respect to perceived sound quality. An improved frequency resolution namely means that more of the perceptually important information contained in the source signal can thus be encoded and forwarded to the receiver.

Furthermore, it is preferable from a computational point of view to utilise signal frames, which include a number of sample values that is suitable for fast Fourier transformation (FFT), for instance, powers of the integer two. The proposed solution provides a perfect freedom to chose an ideal frame size with respect to this.

The invention thus both accommodates an improved perceptual quality and a computationally efficient solution for the transmission of acoustic source signals.

BRIEF DESCRIPTION OF THE DRAWINGS

The present invention is now to be explained more closely by means of preferred embodiments, which are disclosed as examples, and with reference to the attached drawings.

DESCRIPTION OF PREFERRED EMBODIMENTS OF THE INVENTION

Figure 1:
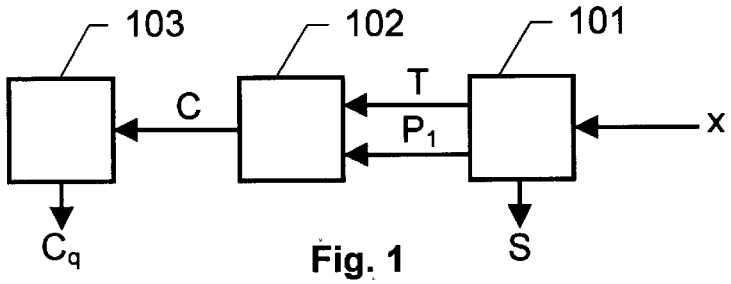
FIG. 1 shows a block diagram over a general transmitter according to the invention.
Figure 9:
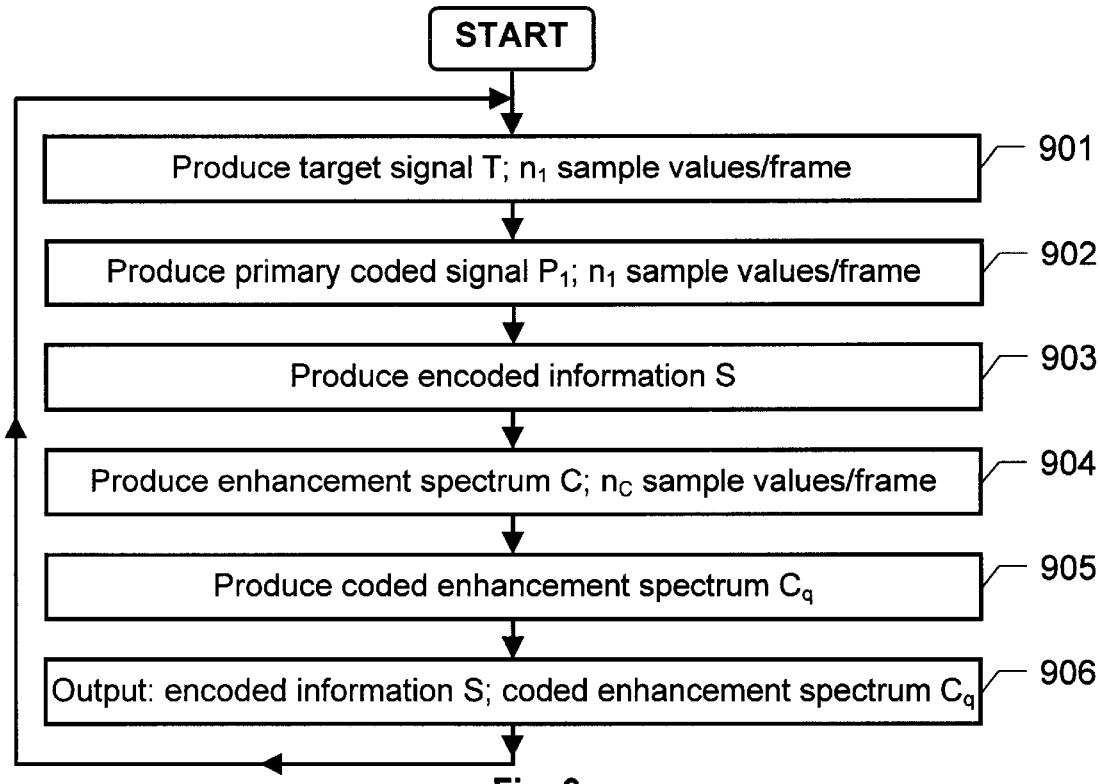
FIG. 9 illustrates in a flow diagram a first aspect of the method according to the invention.

FIG. 1 presents a block diagram over a general transmitter for encoding an acoustic source signal x to produce encoded information S, $C_q$ for transmission over a transmission medium. FIG. 9 illustrates, by means of a flow diagram, corresponding method steps performed by the transmitter. The transmitter includes a primary coder 101 having an input to receive the acoustic source signal x. The primary coder 101 produces, in response to the acoustic source signal x, a target signal T and a primary coded signal $P_1$ which is intended to match the target signal T. Both the target signal T and a primary coded signal $P_1$ are divided into frames, which each comprises a first number $n_1$ of sample values. The target signal T is thus represented by sample values that are treated in groups of which each constitutes a target signal frame. Correspondingly, sample values of the coded signal $P_1$ are grouped together in coded signal frames. The primary coder 101 also generates encoded information S from which the primary coded signal $P_1$ is to be reconstructed by a receiver. The encoded information S thus represents important characteristics of the acoustic source signal x. Examples of data that can be included in the encoded information S will be given with reference to FIGS. 3 and 5.

The actions above carried out by the primary coder 101 correspond to the first three steps 901, 902 and 903 in the flow diagram of FIG. 9, namely producing a target signal T having a first number $n_1$ sample values/frame, producing a primary coded signal $P_1$ having a first number $n_1$ sample values/frame respective producing encoded information S. The target signal T, the primary coded signal $P_1$ and the encoded information S are all produced in response to the incoming acoustic source signal x.

An enhancement estimation unit 102 receives the target signal T and the primary coded signal $P_1$ and produces in response to these signals an enhancement spectrum C from which a receiver is to perceptually improve a reconstruction of the acoustic source signal x. The enhancement spectrum C is generated frame-wisely such that a particular frame of the enhancement spectrum C is based on sample values from at least one frame of the target signal T and at least one frame of the primary coded signal $P_1$. In order to create one frame of the enhancement spectrum C sample values must namely be taken from than more than one of the incoming frames, since a frame of the enhancement spectrum C comprises more sample values than a frame of the target signal T or the primary coded signal $P_1$. According to a preferred embodiment of the invention an enhancement spectrum C frame includes a number of samples, which is a power of the integer two, say 128. Typically, a frame of the target signal frame or a primary coded signal frame includes 80 samples (if one frame represents 5 ms being sampled at a rate of 16 kHz), which thus means that there are 48 (or 60%) more sample values in an enhancement spectrum frame than there are sample values in target signal frame or a primary coded signal frame. This generation of the enhancement signal C is represented in FIG. 9 as a step 904 involving producing an enhancement spectrum C having a second number $n_C$ of sample values/frame. The second number $n_C$ is, as mentioned earlier, larger than the first number $n_1$ and preferably a power of the integer two.

An enhancement coder 103 receives the enhancement spectrum C and produces in response thereto a coded enhancement spectrum $C_q$ that constitutes an encoded representation of the enhancement spectrum C. The encoding of the enhancement spectrum C into the coded enhancement spectrum $C_q$ aims at adapting format the enhancement spectrum C suitable for transmission over a transmission medium. Typically, such adaptation involves quantising the enhancement spectrum C such that it is represented by discrete sample values.

The formation of the coded enhancement spectrum $C_q$ is indicated in FIG. 9 as a step 905 and is followed by a step 906 in which both the encoded information S, generated by the primary coder 101, and the coded enhancement spectrum $C_q$ are output for transmission over the transmission medium, which forms a channel between the transmitter and a receiver of the data S and $C_q$.

The procedure then loops back to encode a subsequent frame of the acoustic source signal x.

The proposed increased block length of the enhancement spectrum (i.e. the spectrum accommodating more spectral coefficients than there are sample values in a frame of the target signal T or the primary coded signal $P_1$). is not a trivial feature to accomplish in practice. In one way or another the frames of the signals on which the enhancement spectrum C is based must be extended to include a number of sample values being equal to the number of spectral coefficients in the enhancement spectrum C.

According to a preferred embodiment of the invention the underlying frames of the target signal respective the primary coded signal are extended by adding a sufficient number of zero-value samples at the end of a relevant frame, i.e. so-called zero-padding. Consequently, if a frame of the target signal and the primary coded signal includes 80 sample values and a frame of the enhancement spectrum includes 256 spectral coefficients, 176 zero-valued samples are added at the end (or in the beginning) of the original sample values contained in each target signal frame and primary coded signal frame.

According to another preferred embodiment of the invention the underlying frames of the target signal respective the primary coded signal are extended by adding a sufficient number of sample values from at least one previous frame to a relevant frame. Hence, if a frame of the target signal and the primary coded signal includes 148 sample values and a frame of the enhancement spectrum includes 256 sample values, 108 sample values from a previous frame are added before the original sample values contained in each target signal frame and primary coded signal frame.

Regardless of according to which of the above presented ways the target signal T and the primary coded signal $P_1$ are extended the enhancement unit 102 carries out the following procedure.

First, an extended target signal frame is produced by extending a relevant target signal frame of the target signal T with sample values up to a total number of sample values being equal to the number of spectral coefficients contained in each frame of the enhancement spectrum C. The thus extended target signal frame is then frequency transformed to represent a spectrum in the frequency domain.

In parallel with this, after or possibly before a corresponding operation is performed with respect to the primary coded signal $P_1$. Thus, an extended primary coded signal is produced by extending a relevant primary coded signal frame with sample values up to a total number of sample values being equal to the number of frames contained in each frame of the enhancement spectrum C. Then, the extended primary coded signal is frequency transformed to represent a spectrum in the frequency domain.

Finally, the enhancement spectrum C is produced from the extended target signal frame and the extended primary coded signal. This can, for instance, be done by dividing the spectrum of the extended target signal with the spectrum of the extended primary coded signal.

According to another preferred embodiment of the invention each of the target signal T and the primary coded signal $P_1$ is multiplied with a window-function $W_1$. The window-function $W_1$ has a total width that corresponds to the number of spectral coefficients included in the enhancement spectrum C and it is centred over a relevant frame of a basis signal, i.e. the target signal T or the primary coded signal $P_1$. However, the window-function $W_1$ only has a maximal magnitude (typically 1) for the first number $n_1$ of sample values, i.e. the number of sample values in the relevant frame. The window-function $W_1$ has a gradually declining magnitude for sample values outside this range, i.e. for sample values from neighbouring frames to the relevant frame. Applying a window-function is generally advantageous for the enhancement estimation.

Figure 7:
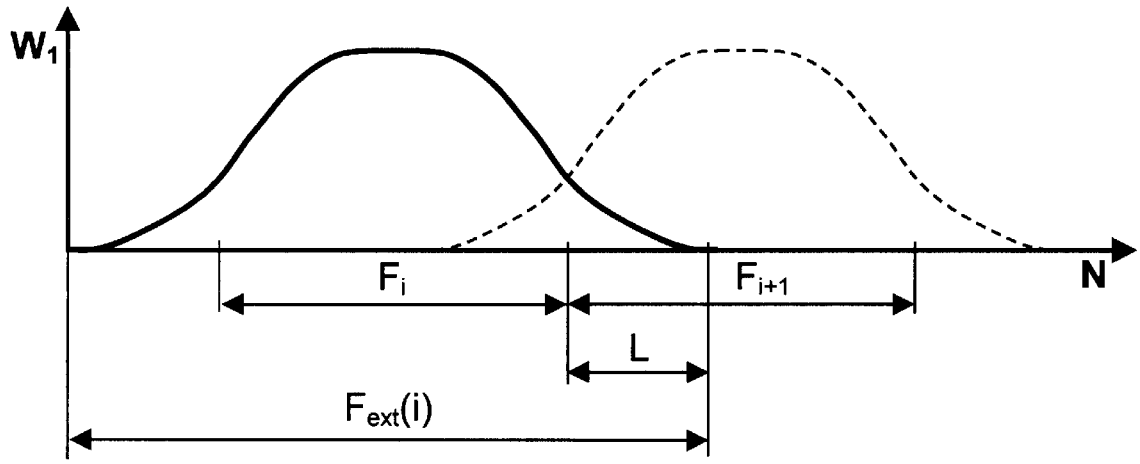
FIG. 7 shows a diagram that illustrates how a symmetric window is applied to a signal frame according to an embodiment of the invention.

FIG. 7 shows a diagram in which an example of a window-function $W_1$ is depicted. The window-function $W_1$ is here symmetric and centred over a relevant frame $F_i$ including a first number of sample values (being indicated along the x-axis as a variable N). The window-function $W_1$ covers $F_{ext}(i)$ not only all sample values of the relevant frame $F_i$, but covers also sample values from a previous frame and a following frame $F_{i+1}$. The sample values of the previous frame are relatively easy to re-use for the relevant frame simply by storing them in a buffer. However, the sample values from the following frame $F_{i+1}$ have yet not been generated by the primary coder 101. Therefore, a coding delay is introduced corresponding to the so-called look-ahead distance L into the following frame $F_{i+1}$. Coding delays are undesired and should be kept to a minimum, since such delays may cause echo effects and also be otherwise annoying to a listener if they become excessive.

According to another preferred embodiment of the invention the window-function is instead placed over the relevant frame such that in addition to the sample values of the relevant frame only historic sample values form the basis for the enhancement spectrum.

Figure 8:
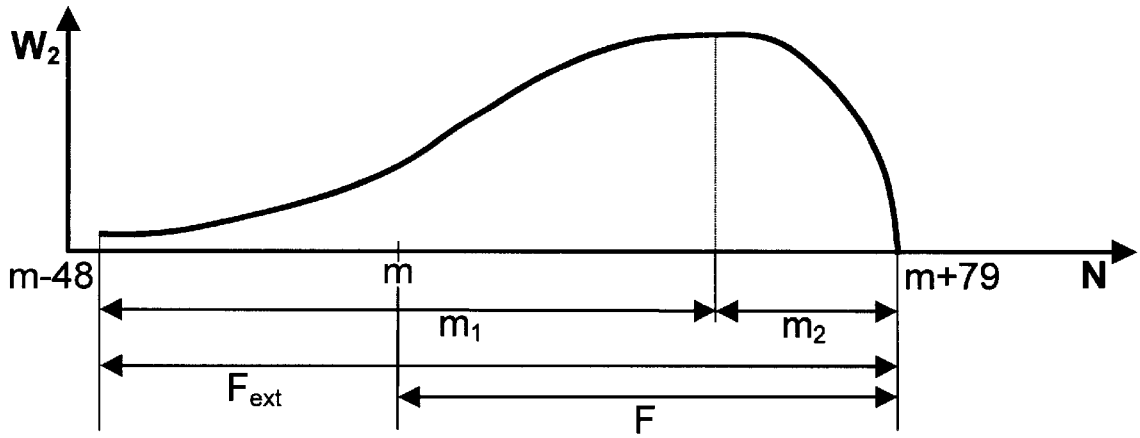
FIG. 8 shows a diagram that illustrates how an asymmetric window is applied to a signal frames according to an embodiment of the invention.

FIG. 8 shows a diagram in which an example of such a window-function $W_2$ is depicted. This window-function $W_2$ is asymmetric (which is preferable, but not necessary) and placed over the entire relevant frame F and extending over at least a part of at least the previous frame. In this example the relevant frame F is assumed to include 80 sample values ranging from N=m to N=m+79. The enhancement spectrum, on the other hand, is assumed to include 128 spectral coefficients ranging from N=m−48 to N=m+79. By multiplication with the window-function $W_2$ the relevant frame thus is extended to an extended relevant frame $F_{ext}$, which also includes sample values located in the range of N=m−48 to N=m+79.

The window-function $W_2$ exemplified in FIG. 8 is a so-called Hamming-Cosine window having the shape of a Hamming window for its initial $m_1$ sample values and a shape corresponding to the first quarter of a cosine wave for its trailing $m_2$ sample values. Naturally, other types of symmetric or asymmetric window-functions, such as Hamming, Hanning, Blackman, Kaiser and Bartlet are also applicable according to the invention.

Although less advantageous, it is also possible to include a look-ahead when an asymmetric window-function is applied. The Hamming-Cosine window could, for instance, in this example, extend to cover sample values above m+79, i.e. future sample values.

If the necessary extension of the target signal T and the primary coded signal $P_1$ is accomplished by means of multiplying their signals frames with a window-function, the enhancement unit 102 carries out the following procedure.

First, a relevant portion of the target signal T is multiplied with a window-function comprising as many sample values as there are spectral coefficients in the enhancement spectrum. The resulting extended target signal frame is then frequency transformed to represent a spectrum in the frequency domain.

In parallel with this, after or possibly before a corresponding operation is performed with respect to the primary coded signal $P_1$. Thus, an extended primary coded signal is produced by multiplying a relevant portion of the primary coded signal with a window-function comprising as many sample values as there are spectral coefficients in the enhancement spectrum. The resulting extended primary coded signal frame is then frequency transformed to represent a spectrum in the frequency domain.

Finally, the enhancement spectrum C is produced from the extended target signal frame and the extended primary coded signal. This can, for instance, be done by dividing the spectrum of the extended target signal with the spectrum of the extended primary coded signal.

According to another preferred embodiment of the invention, the enhancement unit 102 produces the enhancement spectrum C exclusively from sample values from the primary coded signal $P_1$ respective of the target signal T, which represent frequency components above a particular threshold frequency and below an upper passband limit at e.g. 7 kHz (if the sampling frequency is 16 kHz). An appropriate selection of the threshold frequency (at 2 kHz or 3 kHz) namely results in a further improved perceived sound quality of a reconstructed acoustic source signal having been created on basis of the enhancement spectrum C.

The basic coding scheme is normally designed to create an enhancement spectrum C aiming to modify the magnitude of the frequency spectrum of the primary coded signal such that its distance to the target signal is minimised according a certain criterion (e.g. minimum square error, MSE). The phase information of the primary coded signal is generally retained unaffected by the enhancement spectrum C. This can cause so-called blocking effects at the frame boundaries, due to possible signal discontinuities at the frame boundaries where the phase values are not longer in accordance with the modified spectral magnitudes.

If, however, the enhancement spectrum C is based exclusively on the higher frequency components of the target signal T and the primary coded signal $P_1$ these effects can be alleviated considerably. The phase errors causing signal discontinuities at the frame boundaries then mainly occur for the higher frequency components, which have a comparatively low power level. Therefore, the phase errors will only marginally influence the perception of the reconstructed acoustic source signal. Voiced speech sounds in speech signals have comparatively high power levels with respect to low frequency components, whereas for higher frequency components the power levels are relatively low and are thus not noticeably affected by the proposed selective filtering of the target signal T and the primary coded signal $P_1$. Unvoiced speech sounds, however, demonstrate relatively high power levels in the upper frequency band. Due to the noisy character of these types of sounds the blocking effects play a less important role and can consequently be accepted to a larger extent.

A consequence of the selective filtering according to the embodiment above is that only the frequency components in the selected frequency range are modified such that the distance between their respective magnitudes and the corresponding parameters of the target signal is minimised. Frequency components outside the selected frequency range are not modified at all. This may cause a problem if there is relatively large difference between the power level of the target signal T and the power level of the primary coded signal $P_1$. If, for instance, the primary coder 101 is a CELP-coder (CELP=Code Excited Linear Predictive, see FIG. 5) where the primary coded signal $P_1$ is the excitation signal and the target signal is the LPC residual (LPC=Linear Predictive Coding) an incoming unvoiced speech sound may cause the coder to generate a primary coded signal $P_1$ with a comparatively low power level and a target signal T with a comparatively high power level. Assuming that both the primary coded signal $P_1$ and the target signal T have spectrally flat frequency spectra (i.e. substantially representing white noise) the enhancement spectrum C should also have a spectrally flat frequency spectrum. The selective filtering, however, leads to an enhancement spectrum C having a tilted frequency spectrum (i.e. non-flat). As a consequence, the reconstructed acoustic source signal will have an unnecessary poor sound quality.

According to another preferred embodiment of the invention, the power level of the target signal T is therefore adjusted during production of the enhancement spectrum C such that the power of the target signal T is attenuated to a value being substantially the same as the power of the primary coded signal $P_1$ for spectral components below the threshold frequency (at e.g. 2 kHz or 3 kHz as mentioned above). This alleviates the problem addressed at the end of the penultimate paragraph, since the frequency spectrum of the enhancement spectrum C is maintained flat when the incoming acoustic source signal is an unvoiced speech sound.

Alternatively, the power level of the primary coded signal $P_1$ can be adjusted during production of the enhancement spectrum C such that the power of the primary coded signal $P_1$ is amplified to a value being substantially the same as the power of the target signal T for spectral components below the threshold frequency.

According to another preferred embodiment of the invention, the enhancement spectrum C is limited to have coefficient values between a lower and an upper boundary. This measure represents an alternative solution to the problems caused by signal discontinuities at frame boundaries.

A limitation of the coefficient values in the enhancement spectrum C means that if a reconstructed primary coded signal enhanced by a reconstructed enhancement spectrum is in no spectral component amplified by more than 10 dB (i.e. a factor 3.16) or in no spectral component attenuated by more than 10 dB (i.e. a factor 0.316) the variation in the individual frequency components will also be held within certain boundaries. The effect of discontinuities between frames will hence be so limited that they are perceptually irrelevant.

According to another preferred embodiment of the invention, the enhancement coder 103 produces the coded enhancement spectrum $C_q$ by applying a non-uniform quantisation scheme to the enhancement spectrum C. The generation of the coded enhancement spectrum $C_q$ may, for instance, involve transforming the enhancement spectrum C from a linear to a logarithmic domain. Such a transformation prior to quantisation is appropriate from a perceptual point of view, since the human hearing with respect to acoustic loudness is approximately logarithmic.

According to another preferred embodiment of the invention, the production of the coded enhancement spectrum $C_q$ involves combining at least two separate frequency components of the enhancement spectrum C into a joint frequency component. The human hearing is namely less sensitive to quantisation errors in the signal magnitude for higher frequency components. It is therefore sufficient to quantise such frequency components with a lower resolution than what is used for frequency components in the lower frequency band. The human sound perception can be approximated with so-called critical band filters, whose bandwidth are essentially proportional to a logarithmic frequency scale. The Bark scale and the Mel scale constitute two examples of such division of the frequency band. An arithmetic average or median coefficient value of the coefficients in each band can replace the individual coefficient values in the respective band in order to obtain a reduction of the amount of information in the enhancement spectrum C without noticeable reduction of the perceived sound quality of the reconstructed signal.

The procedure performed by the enhancement coder 103 hence includes a first step of dividing at least a part of a frequency spectrum of the enhancement spectrum C into one or more frequency bands and a second step of deriving a joint frequency component for each of the frequency bands.

According to another preferred embodiment of the invention, the production of the enhancement spectrum $C_q$ involves transforming the enhancement spectrum C into a cepstral transformed enhancement spectrum and discarding of cepstral coefficients in the cepstral transformed enhancement signal above a particular order. These high order cepstral coefficients namely represent a perceptually irrelevant fine structure of the enhancement spectrum C and can therefore be discarded without a noticeable reduction of the perceived sound quality in the reconstructed acoustic source signal.

According to another preferred embodiment of the invention, the production of the enhancement spectrum $C_q$ involves detecting whether a relevant signal frame of the target signal T or the primary coded signal $P_1$ is estimated to represent a voiced sound or an unvoiced sound. In the former case the enhancement spectrum C is derived and quantised for a relatively narrow frequency range (say 2 kHz–4 kHz) and in the latter case the enhancement spectrum C is derived and quantised for a relatively broad frequency range (say 3 kHz–7 kHz). Unvoiced speech sounds namely have a relatively flat frequency spectrum (requiring a uniform resolution) whereas voiced speech sounds have a frequency spectrum with a comparatively steep down slope in the high frequency band (requiring a better resolution for lower frequencies than for higher frequencies). In case the speech codec includes an adaptive code book (e.g. CELP-coder) a current gain value, $g_1$ in FIG. 5, can be used to detect whether an encoded signal represents a voiced or an unvoiced sound. For instance, a gain value $g_1$ below 0.5 indicates an unvoiced sound and a gain value $g_1$ of 0.5 or higher indicates a voiced sound.

All the measures proposed above could, of course, be implemented by means of a computer program directly loadable into the internal memory of a computer, which includes appropriate software for controlling the necessary steps when the program is run on a computer. The computer program can likewise be recorded onto arbitrary kind of computer readable medium.

Figure 2:
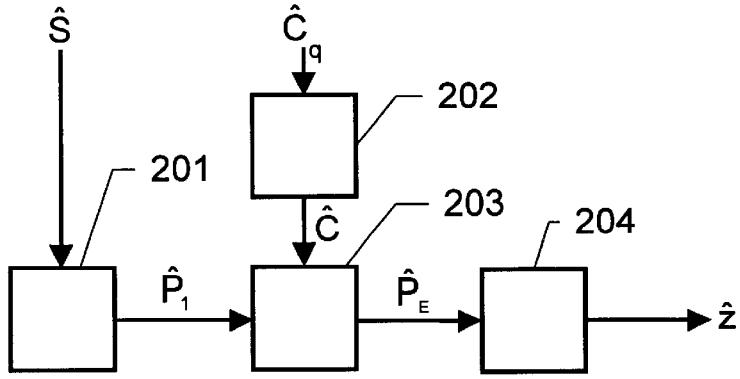
FIG. 2 shows a block diagram over a general receiver according to the invention.
Figure 10:
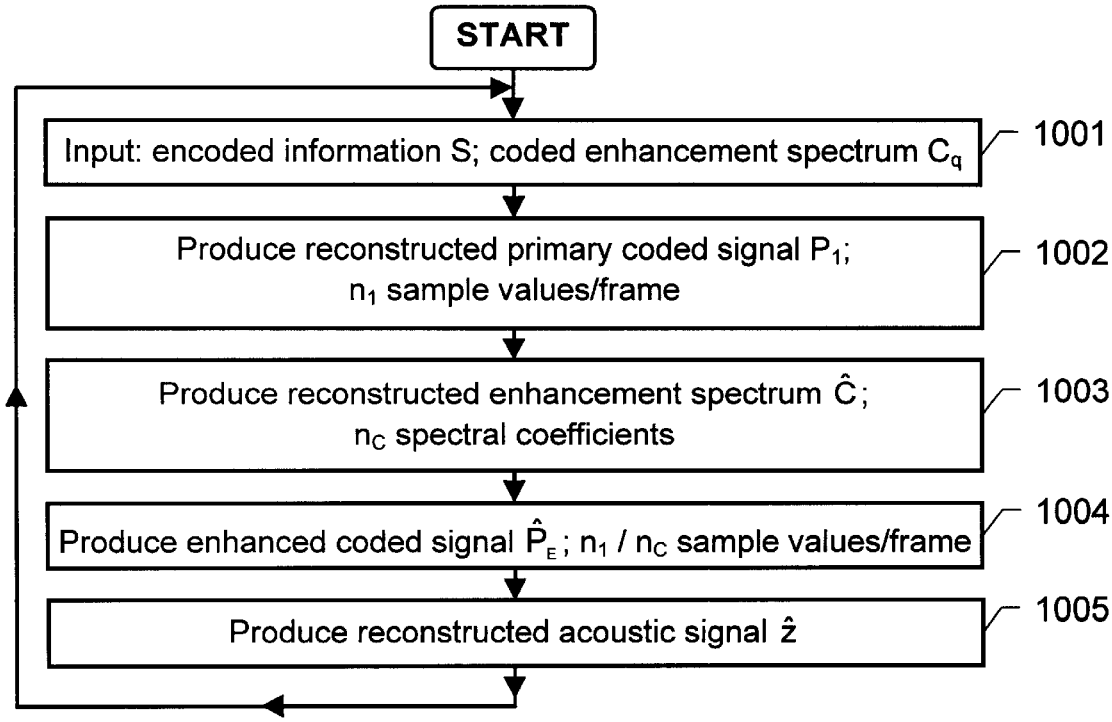
FIG. 10 illustrates in a flow diagram a second aspect of the method according to the invention.

A block diagram over a general receiver according to the invention is shown in FIG. 2. FIG. 10 shows a flow chart over a corresponding method performed by the receiver. Estimates of encoded information S; $C_q$ having been transmitted through a transmission medium reach the receiver. This is represented by a first step 1001 in FIG. 10.

A primary decoder 201 then receives an estimate of encoded information $\hat{S}$ from which a reconstructed primary coded signal $\hat{P}_1$ is generated. The reconstructed primary coded signal $\hat{P}_1$ is divided into reconstructed primary coded signal frames, which each comprises a first number $n_1$ of sample values. This is represented by a second step 1002 in FIG. 10.

Correspondingly, an enhancement decoder 202 receives an estimate of a coded enhancement spectrum $\hat{C}_q$ and produces a reconstructed enhancement spectrum $\hat{C}$. The reconstructed enhancement spectrum $\hat{C}$ comprises a second number $n_C$ spectral coefficients. This corresponds to reconstructed enhancement signal frames (in the time domain), which each comprises the second number $n_C$ of sample values. According to the invention, the second number $n_C$ is larger than the first number $n_1$. This is represented by a third step 1003 in FIG. 10.

The reconstructed enhancement spectrum $\hat{C}$ and the reconstructed primary coded signal $\hat{P}_1$ are forwarded to an enhancement unit 203, which provides an enhanced reconstructed primary coded signal $\hat{P}_E$ in response thereto. The spectrum of the enhanced reconstructed primary coded signal $\hat{P}_E$ also comprises the second number $n_C$ spectral coefficients. In order to produce the enhanced reconstructed primary coded signal $\hat{P}_E$ the enhancement unit 203 extends each incoming reconstructed primary coded signal frame to comprise the second number $n_C$ of sample values according to the methods described earlier. The enhanced reconstructed primary coded signal $\hat{P}_E$ is then derived by frequency transforming the reconstructed primary coded signal $\hat{P}_1$ to obtain a corresponding spectrum, multiplying this spectrum with the reconstructed enhancement spectrum $\hat{C}$ and inverse frequency transforming the result thereof. This operation produces the enhanced reconstructed primary coded signal $\hat{P}_E$ having the second number $n_C$ spectral coefficients.

If a following synthesis 204 so demands, in order to generate a reconstructed acoustic source signal $\hat{z}$ with correct number of sample values per frame (i.e. typically the first number $n_1$), the number of spectral coefficients in the enhanced reconstructed primary coded signal $\hat{P}_E$ is reduced (e.g. by resampling) to again obtain a total of the first number $n_1$ of spectral coefficients.

Depending on the capabilities of the requirements process the enhanced reconstructed primary coded signal $\hat{P}_E$ is hence forwarded to the synthesis filter 204 either with the first number $n_1$ or the second number $n_C$ spectral coefficients. A reduction from the second number $n_C$ of sample values to the first number $n_1$ of sample values is accomplished by discarding those sample values in a relevant primary coded signal frame, which correspond to added sample values over the first number $n_1$. This is represented by a fourth step 1004 in FIG. 10. The synthesis filter 204 then produces a reconstructed acoustic source signal $\hat{z}$ in response thereto. This is represented by a fifth step 1005 in FIG. 10. The procedure then loops back to decode a subsequent signal frame.

According to a preferred embodiment of the invention, and in similarity with the proposed encoding method, the enhanced reconstructed primary coded signal $\hat{P}_E$ is produced by using sample values from a reconstructed enhancement spectrum and sample values from at least one reconstructed primary coded signal frame.

The extension of the reconstructed primary coded signal frame can involve addition of sample values from at least one previous reconstructed primary coded signal frame to the relevant reconstructed primary coded signal frame. Alternatively, the reconstructed primary coded signal frame can be extended by addition of empty sample values to the relevant reconstructed primary coded signal frame. Such sample values may be added either in the end or in the beginning of the original frame (so-called zero-padding).

According to a preferred embodiment of the invention, an extended frame including the second number $n_C$ of sample values from the reconstructed primary coded signal $\hat{P}_1$ is produced by multiplying the reconstructed primary coded signal $\hat{P}_1$ with a window-function comprising the second number $n_C$ of sample values and being centred over a relevant target signal frame. The window-function can either be symmetric or asymmetric. An asymmetric window-function is preferably applied such that only current and historical sample values are included in the extended frame of the reconstructed primary coded signal $\hat{P}_1$. FIG. 8 shows an example of a suitable asymmetric window-function $W_2$.

According to another preferred embodiment of the invention, a symmetric window function is used. This window-function has a total width that corresponds to the number of spectral coefficients included in the enhancement spectrum C (e.g. the second number $n_C$) and it is centred over a relevant frame of the primary coded signal $P_1$. The window-function has a maximal magnitude (typically 1) for the first number $n_1$ of sample values, i.e. the number of sample values in the relevant frame of the primary coded signal $P_1$, and a gradually declining magnitude for sample values outside this range, i.e. for sample values from neighbouring frames to the relevant frame.

The enhanced reconstructed primary coded signal $\hat{P}_E$ having a spectrum, which includes the second $n_C$ of spectral coefficients, can thus be produced on basis of the extended frame of the reconstructed primary coded signal $\hat{P}_1$ and the reconstructed enhancement spectrum $\hat{C}$. The second number $n_C$ is preferably a power of the integer two, because this enables efficient further processing of the resulting enhanced reconstructed primary coded signal $\hat{P}_E$, for instance by means of fast Fourier transform (FFT).

A theoretical alternative to avoid extending the reconstructed primary coded signal frames before applying the reconstructed enhancement spectrum $\hat{C}$ and to then also avoid reducing the frame size of the enhanced reconstructed primary coded signal $\hat{P}_E$ prior to synthesis filtering would be to resample the reconstructed enhancement spectrum $\hat{C}$ at the first number $n_1$ of sample points such that an enhanced reconstructed primary coded signal $\hat{P}_E$ could be created with only the first number $n_1$ spectral coefficients. This would, however, deteriorate the perceptual quality gained by the longer block length of the enhancement spectrum $\hat{C}$ frame in an undesirable manner.

All the decoding measures proposed above could, of course, be implemented by means of a computer program directly loadable into the internal memory of a computer, which includes appropriate software for controlling the necessary steps when the program is run on a computer. The computer program can likewise be recorded onto arbitrary kind of computer readable medium.

Figure 3:
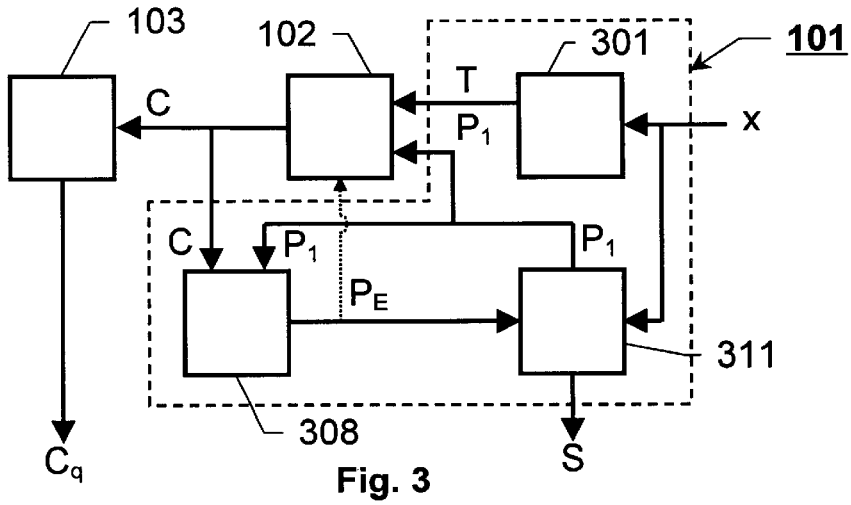
FIG. 3 shows a block diagram over a transmitter according to a first embodiment the invention.

FIG. 3 shows a block diagram over a transmitter according to a first embodiment the invention. The transmitter is a so-called LPAS-encoder (LPAS=Linear Predictive Analysis-by-Synthesis), in which the primary coder 101 includes an inverse synthesis filter 301. This filter 301 receives an acoustic source signal x and generates in response thereto a target signal T. The primary coder 101 further includes one or more units (not shown), e.g. to perform LPC-analysis, and an excitation generator 311. The excitation generator 311 receives the acoustic source signal x and produces, in response thereto, a primary coded signal $P_1$ and encoded information S. The encoded information S is transmitted to a receiver for reconstruction of the primary coded signal $P_1$.

An enhancement unit 308 generates an enhanced primary coded signal $P_E$ (representing an enhanced excitation signal), which is intended to simulate an enhanced reconstructed primary coded signal $\hat{P}_E$ generated in a receiver, and feeds back this signal to the excitation generator 311. The excitation generator 311 can thus modify its internal states such that it creates encoded information S respective a primary coded signal $P_1$ that better describes the acoustic source signal x.

The transmitter further includes an enhancement estimation unit 102, which receives the target signal T and the primary coded signal $P_1$ and produces in response to these signals an enhancement spectrum C according to the method described with reference to the FIGS. 1 and 9 above.

According to a preferred embodiment of the invention, the enhanced primary coded signal $P_E$ is fed to the enhancement estimation unit 102 as an alternative to the primary coded signal $P_1$. This is indicated by means of a dotted line in FIG. 3. Sample values from a previous enhanced primary coded signal frame $P_E$ thus contributes to the generation of a current enhancement spectrum C.

An enhancement coder 103 receives the enhancement spectrum C and produces in response thereto a coded enhancement spectrum $C_q$ that constitutes an encoded representation of the enhancement spectrum C. The coded enhancement spectrum $C_q$ represents a format of the enhancement spectrum C, which is suitable for transmitting the signal over a transmission medium.

In addition to the primary coded signal $P_1$ the enhancement unit 308 also receives the enhancement spectrum C. The enhanced primary coded signal $P_E$ (enhanced excitation signal) is produced on basis of both the primary coded signal $P_1$ and the enhancement spectrum C.

In an alternative embodiment of the invention, the enhancement unit 308 is excluded from the primary coder 101. The synthesis filter 311 is then, in contrast to what has been described above, not adaptive with respect to the enhanced primary coded signal $P_E$.

Figure 4:
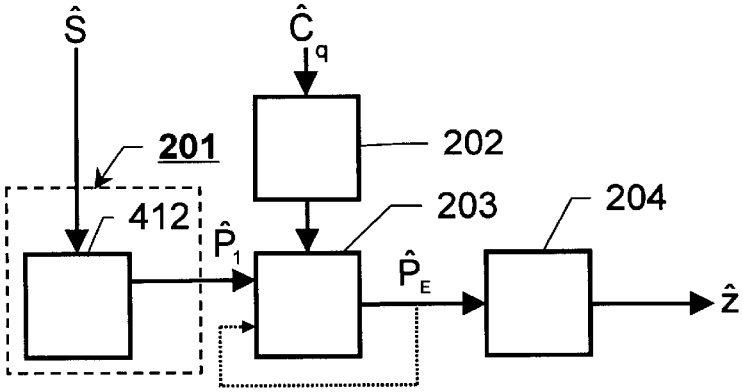
FIG. 4 shows a block diagram over a receiver according to a first embodiment the invention.

FIG. 4 shows a block diagram over a receiver according to a first embodiment the invention, which is adapted for receiving encoded information generated by the transmitter shown in FIG. 3. The receiver is thus an LPAS-decoder. Its primary decoder 201 includes an excitation generator 412, which receives an estimate of the encoded information $\hat{S}$ and generates in response thereto a reconstructed primary coded signal $\hat{P}_1$. The remaining units 202, 203 and 204 in the receiver have the same functions and characteristics as those described for the units bearing the same reference numbers in FIG. 2 above.

According to an aspect of this first embodiment of the invention, the enhanced reconstructed primary coded signal $\hat{P}_E$ is fed back as an input signal to the enhancement unit 203 such that sample values from a previous enhanced reconstructed primary coded signal frame $\hat{P}_E$ contributes to the generation of a current enhanced reconstructed primary coded signal frame $\hat{P}_E$. This is indicated by means of a dotted line in FIG. 4.

Figure 5:
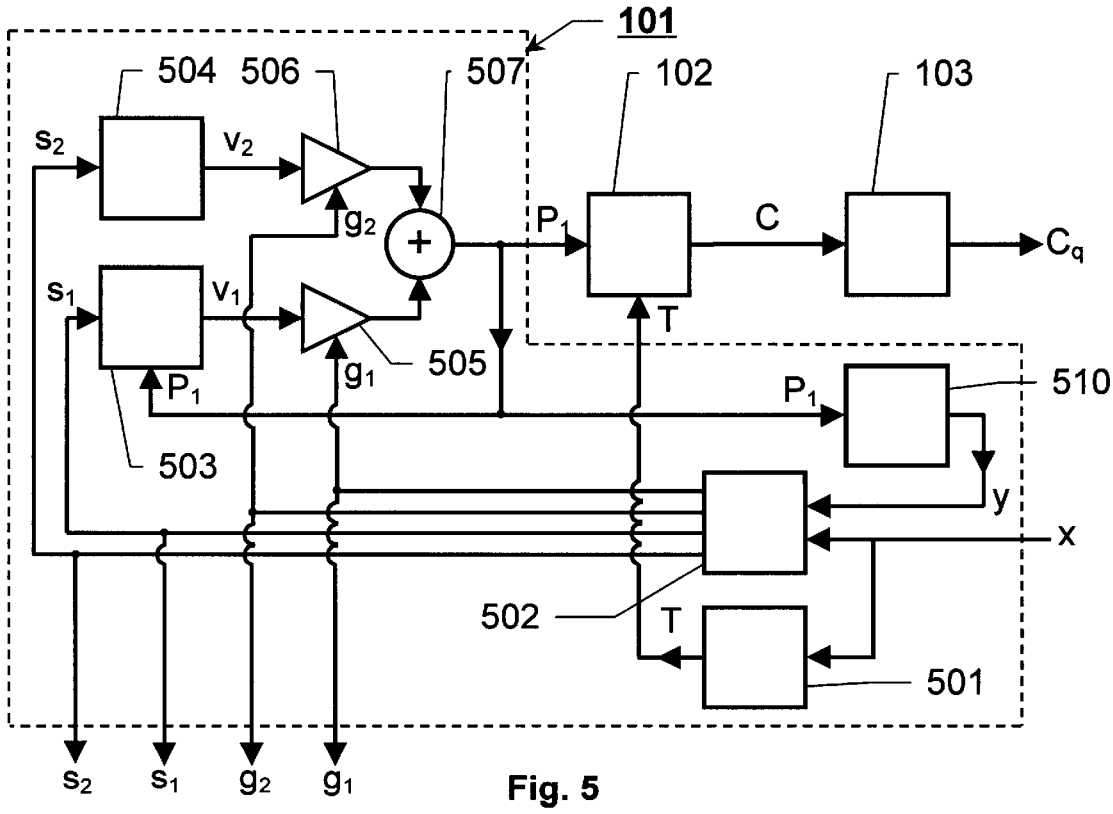
FIG. 5 shows a block diagram over a transmitter according to a second embodiment the invention.

FIG. 5 shows a block diagram over a transmitter according to a second embodiment the invention. The transmitter is a so-called CELP-encoder, which includes an algebraic code book 504.

The primary coder 101 of this transmitter includes a search unit 502 into which an acoustic source signal x is fed. An inverse synthesis filter 501 also receives the acoustic source signal x. The inverse synthesis filter 501 produces, in response to the acoustic source signal x, a target signal T that is forwarded to an enhancement estimation unit 102.

Besides the acoustic source signal x, the search unit 502 also receives a locally reconstructed acoustic source signal y, which is generated by a synthesis filter 510 likewise included in the primary coder 101. The synthesis filter 510 is identical to a corresponding filter in a receiver intended to receive and reconstruct the encoded information generated by the transmitter. The synthesis filter 510 simulates the receiver and thus enables the search unit 502 to adjust its parameters such that the locally reconstructed acoustic source signal y resembles the acoustic source signal x as much as possible. The search unit 502 produces a first pointer $s_1$, which addresses a first vector $v_1$ in an adaptive code book 503. A following first adaptive amplifier 505 gives the vector $v_1$ desired amplitude, which is also set by the search unit 502 through a first gain value $g_1$. Moreover, the search unit 502 produces a second pointer $s_2$, which addresses a second vector $v_2$ in the algebraic code book 503. Correspondingly, the second vector $v_2$ is given desired amplitude by a second adaptive amplifier 506, which is controlled by the search unit 502 via a second gain value $g_2$. A combiner 507 adds the amplified first and second vectors $g_1v_1$ and $g_2v_2$ and forms a primary coded signal $P_1$. This signal $P_1$ is fed back to the adaptive code book 503, forwarded to the synthesis filter 510 as a basis for the locally reconstructed acoustic source signal y and to an enhancement estimation unit 102.

The enhancement estimation unit 102 also receives the target signal T from the inverse synthesis filter 501 and produces in response to these signals an enhancement spectrum C according to the method described with reference to FIGS. 1 and 9 above. An enhancement coder 103 receives the enhancement spectrum C and produces in response thereto a coded enhancement spectrum $C_q$ constituting an encoded representation of the enhancement spectrum C. The coded enhancement spectrum $C_q$ represents a format of the enhancement spectrum C, which is suitable for transmitting the signal over a transmission medium to a receiver.

The parameters $s_1$, $s_2$, $v_1$ and $v_2$ generated by the search unit 502, which constitute the encoded information S in FIG. 1, are also transmitted over the transmission medium to a receiver. The encoded information S may additionally include other encoded information, such as LPC-information (not shown here).

According to an alternative embodiment of the invention, an enhancement unit (corresponding to 308 in FIG. 3, not shown) is included between the adaptive code book 503 and the synthesis filter 510, which receives the primary coded signal $P_1$ and generates in response thereto an enhanced primary coded signal $P_E$. In this alternative embodiment the enhanced primary coded signal $P_E$ is thus locally generated and fed back to the adaptive code book 503 and the synthesis filter 510 respectively in place of the primary coded signal $P_1$.

Figure 6:
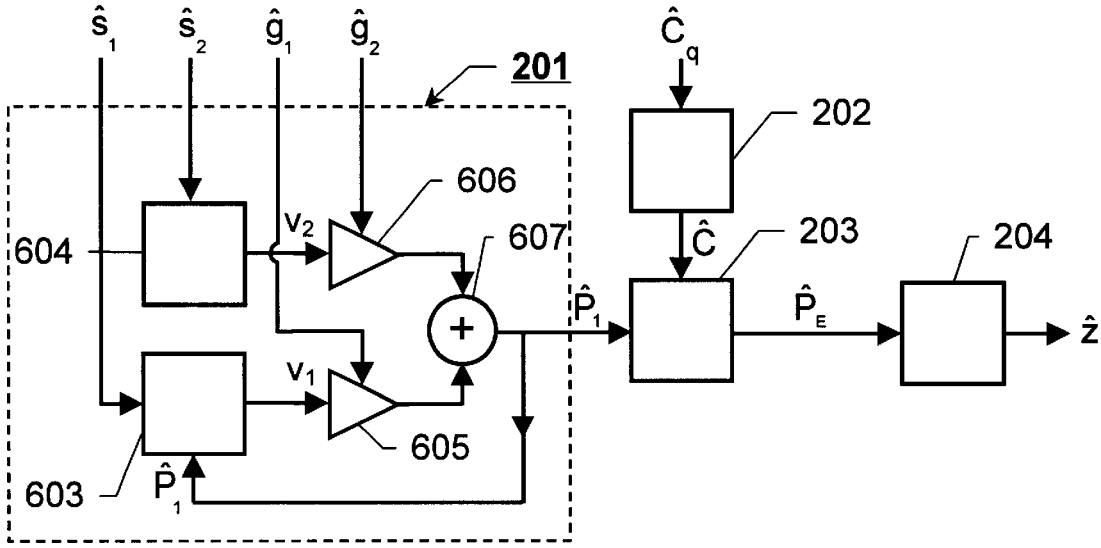
FIG. 6 shows a block diagram over a receiver according to a second embodiment the invention.

FIG. 6 shows a block diagram over a receiver according to a second embodiment the invention, which is intended to receive encoded information generated by the transmitter shown in FIG. 5 and to reconstruct this information into an estimate of an acoustic source signal.

The receiver includes a primary decoder 201, which comprises an adaptive code book 603, an algebraic code book 604, a first adaptive amplifier 605, a second adaptive amplifier 606 and a combiner 607. An estimate of the first pointer $\hat{s}_1$ addresses a first vector $v_1$ in the adaptive code book 603, which, via the first adaptive amplifier 605, is given an amplitude by an estimate $\hat{g}_1$ of the first gain value. Correspondingly, an estimate of the second pointer $\hat{s}_2$ addresses a second vector $v_2$ in the algebraic code book 604, which, via the second adaptive amplifier 606, is given an amplitude by an estimate $\hat{g}_2$ of the second gain value. The combiner 607 adds the amplified first and second vectors $\hat{g}_1v_1$ and $\hat{g}_2v_2$ and forms a reconstructed primary coded signal $\hat{P}_1$. This signal $\hat{P}_1$ is fed back to the adaptive code book 603 and forwarded to an enhancement unit 203.

An enhancement decoder 202 receives an estimate of a coded enhancement spectrum $\hat{C}_q$ and produces a reconstructed enhancement spectrum $\hat{C}$ according to the procedure described with reference to FIG. 2 above. Likewise, the enhancement unit 203 produces an enhanced reconstructed primary coded signal $\hat{P}_E$ and a following synthesis filter 204 generates a reconstructed acoustic source signal $\hat{z}$.

Any of the proposed transmitters and receivers can, of course, be combined to form a communication system for exchanging encoded acoustic source signals between a first and a second node. Such system includes, besides the transmitter and the receiver, a transmission medium for transporting encoded information from the transmitter to the receiver.

The term "comprises/comprising" when used in this specification is taken to specify the presence of stated features, integers, steps or components. However, the term does not preclude the presence or addition of one or more additional features, integers, steps or components or groups thereof.

The invention is not restricted to the described embodiments in the figures, but may be varied freely within the scope of the following claims.

What is claimed is:

1. A method of encoding an acoustic source signal to produce encoded information for transmission over a transmission medium, comprising:

producing, in response to the acoustic source signal, a target signal being divided into frames, which each comprises a first number of sample values;

producing, in response to the acoustic source signal, a primary coded signal that is intended to match the target signal, the primary coded signal being divided into frames, which each comprises the first number of sample values;

producing, in response to the acoustic source signal, encoded information from which the primary coded signal is to be reconstructed;

producing, in response to the primary coded signal and the target signal, an enhancement spectrum indicative of how well the primary coded signal matches the target signal; and producing, in response to the enhancement spectrum, a coded enhancement spectrum constituting an encoded representation of the enhancement spectrum, wherein: an enhancement spectrum frame of the enhancement spectrum comprises a second number of spectral coefficients, the second number being larger than the first number.

2. A method according to claim 1, wherein the enhancement spectrum is frame-wisely produced such that one enhancement spectrum frame is based on sample values from at least one frame of the target signal and at least one frame of the primary coded signal.

3. A method according to claim 1, wherein the second number is a power of the integer two.

4. A method according to claim 1, further comprising:

producing an extended target signal frame by extending a relevant target signal frame of the target signal with sample values up to a total number of sample values being equal to the second number, frequency transforming the extended target signal frame;

producing an extended primary coded signal by extending a relevant primary coded signal frame with sample values up to a total number of sample values being equal to the second number;

frequency transforming the extended primary coded signal; and producing the enhancement spectrum from the extended target signal frame and the extended primary coded signal.

5. A method according to claim 4, wherein the extension of sample values involves addition of sample values from a previous signal frame to the relevant signal frame.

6. A method according to claim 4, wherein the extension of sample values involves addition of sample values from a previous enhanced primary coded signal frame to the relevant signal frame of the enhanced primary coded signal.

7. A method according to claim 4, wherein the extension of sample values involves addition of empty values to the relevant signal frame.

8. A method according to claim 1, further comprising:

multiplying the target signal with a window-function comprising the second number of sample values and being centred over a relevant target signal frame;

frequency transforming the target signal;

multiplying the primary coded signal with a window-function comprising the second number of sample values and being centred over a relevant primary coded signal frame; and frequency transforming the primary coded signal.

9. A method according to claim 8, wherein the window-function is symmetric.

10. A method according to claim 8, wherein the window-function is asymmetric.

11. A method according to claim 10, wherein the window-function is a Hamming-Cosine window being applied to a third number of sample values of a previous signal frame and all sample values of the current signal frame.

12. A method according to claim 11, wherein the Hamming-Cosine window exclusively includes sample values of the previous signal frame and the current signal frame.

13. A method according to claim 8, wherein the window-function includes:

a first range comprising the first number of sample values for which the window-function has a constant magnitude, the first range corresponding to the relevant primary coded signal frame; and a second range of sample values outside the first range for which the window-function has a gradually declining magnitude.

14. A method according to claim 1, further comprising:

producing the enhancement spectrum exclusively from sample values of the primary coded signal respective the target signal, which represent frequency components above a threshold frequency.

15. A method according to claim 14, further comprising during production of the enhancement spectrum adjusting the power level of the target signal such that the power level of the target signal is attenuated to a value being substantially the same as the power level of the primary coded signal for a frequency band represented by frequency components below the threshold frequency.

16. A method according to claim 14, further comprising during production of the enhancement spectrum adjusting the power level of the primary coded signal such that the power level of the primary coded signal is amplified to a value being substantially the same as the power level of the target signal for a frequency band represented by frequency components below the threshold frequency.

17. A method according to claim 14, wherein the enhancement spectrum is limited to having coefficient values between a lower and is an upper boundary.

18. A method according to claim 17, wherein the lower boundary represents an attenuation by 10 dB and the upper boundary represents an amplification by 10 dB.

19. A method according to claim 1, wherein the coded enhancement spectrum constitutes a non-uniform quantization of the enhancement spectrum.

20. A method according to claim 19, wherein the producing of the coded enhancement spectrum involves transforming the enhancement spectrum from a linear to a logarithmic domain.

21. A method according to claim 19, wherein the producing of the coded enhancement spectrum involves combining at least two separate frequency components of the enhancement spectrum into a joint frequency component.

22. A method according to claim 21, further comprising:

dividing at least a part of a frequency spectrum of the enhancement spectrum into at least one frequency band; and deriving a joint frequency component for each of the at least one frequency band.

23. A method according to claim 21, wherein the joint frequency component represents an arithmetic average value of the at least two separate frequency components.

24. A method according to claim 21, wherein the joint frequency component represents a median value of the at least two separate frequency components.

25. A method according to claim 19, wherein the producing of the coded enhancement spectrum involves:

transforming the enhancement spectrum into a cepstral transformed enhancement signal; and discarding cepstral coefficients of the cepstral transformed enhancement signal above a particular order.

26. A method according to claim 19, wherein the producing of the coded enhancement spectrum involves:

detecting whether a relevant signal frame is estimated to represent a voiced sound or an unvoiced sound;

quantizing the enhancement spectrum for a relatively narrow frequency range if a voiced sound is detected; and quantizing the enhancement spectrum for a relatively broad frequency range if an unvoiced sound is detected.

27. A method according to claim 26, further comprising:

detecting an unvoiced sound if an adaptive code book gain has a gain value below 0.5; and detecting a voiced if an adaptive code book gain has a gain value of 0.5 or higher.

28. A computer program directly loadable into the internal memory of a computer, comprising software for controlling the steps of claim 1 when said program is run on a computer.

29. A computer readable medium, having a program recorded thereon, where the program is to make a computer control the steps of claim 1.

30. A method of decoding encoded information having been transmitted via a transmission medium, comprising:

producing a reconstructed primary coded signal in response to an estimate of encoded information having been received from the transmission medium, the reconstructed primary coded signal being divided into reconstructed primary coded signal frames, which each comprises a first number of sample values;

producing a reconstructed enhancement spectrum in response to an estimate of a coded enhancement spectrum having been received from the transmission medium, the reconstructed enhancement spectrum being divided into reconstructed enhancement spectrum frames, which each comprises a second number of spectral coefficients;

producing an enhanced reconstructed primary coded signal in response to the reconstructed primary coded signal and the reconstructed enhancement spectrum; and producing a reconstruction of the acoustic source signal in response to the enhanced reconstructed primary coded signal wherein:

the second number is larger than the first number, and the production of the enhanced reconstructed primary coded signal involves extension of a relevant reconstructed primary coded signal frame to comprise the second number of sample values.

31. A method according to claim 30, wherein a reconstructed target signal frame of the enhanced reconstructed primary coded signal is produced by using sample values from one reconstructed enhancement spectrum frame and sample values from at least one reconstructed primary coded signal frame.

32. A method according to claim 30, wherein the second number is a power of the integer two.

33. A method according to claim 30, wherein the enhanced reconstructed primary coded signal is produced by:

extending a relevant reconstructed primary coded signal frame with sample values up to a total number of sample values being equal to the second number to form an extended reconstructed primary coded signal frame;

multiplying the frequency transform of the extended reconstructed primary coded signal frame with a relevant reconstructed enhancement spectrum frame to form a spectrum of the enhanced reconstructed primary coded signal; and inverse frequency transforming the spectrum of the enhanced reconstructed primary coded signal.

34. A method according to claim 33, wherein an enhanced coded signal is generated by an operation involving multiplication of the extended reconstructed primary coded signal frame with a window-function comprising the second number of sample values and being centered over a relevant target signal frame.

35. A method according to claim 34, wherein the window-function is symmetric.

36. A method according to claim 34, wherein the window-function is asymmetric.

37. A method according to claim 34, wherein the window-function includes:

a first range comprising the first number of sample values for which the window-function has a constant magnitude, the first range corresponding to the relevant reconstructed primary coded signal frame; and a second range of sample values outside the first range for which the window-function has a gradually declining magnitude.

38. A method according to claim 30, wherein the extension of the reconstructed primary coded signal frame involves addition of sample values from a previous reconstructed primary coded signal frame to the relevant reconstructed primary coded signal frame.

39. A method according to claim 30, wherein extension of the reconstructed primary coded signal frame involves addition of sample values from a previous reconstructed enhanced primary coded signal frame to the relevant signal frame of the reconstructed enhanced primary coded signal.

40. A method according to claim 30, wherein the extension of the reconstructed primary coded signal frame involves addition of empty sample values to the relevant reconstructed primary coded signal frame.

41. A computer program directly loadable into the internal memory of a computer, comprising software for controlling the steps of claim 30 when said program is run on a computer.

42. A computer readable medium, having a program recorded thereon, where the program is to make a computer control the steps of claim 30.

43. A transmitter for encoding an acoustic source signal to produce encoded information for transmission over a transmission medium comprising:

a primary coder having:

an input to receive the acoustic source signal;

a first output for providing a target signal being divided into target signal frames, which each comprises a first number of sample values;

a second output for providing a primary coded signal being intended to match the target signal, the primary coded signal being divided into target signal frames, which each comprises the first number of sample values; and a third output for providing encoded information from which the primary coded signal is to be reconstructed by a receiver;

an enhancement estimation unit having:

a first input to receive the target signal;

a second input to receive the primary coded signal; and an output for providing an enhancement spectrum from which a receiver is to perceptually improve a reconstruction of the acoustic source signal; and an enhancement coder having:

an input to receive the enhancement spectrum; and an output for providing a coded enhancement spectrum constituting a quantized representation of the enhancement spectrum wherein:

an enhancement spectrum frame of the enhancement spectrum comprises a second number of spectral coefficients, the second number being larger than the first number, and the enhancement estimation unit performs extension of an incoming target signal frame to comprise the second number of sample values and extension of an incoming primary coded signal frame to comprise the second number of sample values.

44. A transmitter according to claim 43, wherein the enhancement estimation unit produces an enhancement spectrum frame by using sample values from at least one primary coded signal frame and using sample values from at least one target signal frame.

45. A transmitter according to claim 43, wherein the second number is a power of the integer two.

46. A transmitter according to claim 43, wherein the enhancement estimation unit extends an incoming signal frame by adding sample values from a previous signal frame to the incoming signal frame.

47. A transmitter according to claim 43, wherein the enhancement estimation unit produces an enhancement spectrum frame by using sample values from at least one previous enhanced primary coded signal frame.

48. A transmitter according to claim 43, wherein the enhancement estimation unit extends an incoming signal frame by adding empty sample values to the incoming signal frame.

49. A transmitter according to claim 43, wherein the primary coder comprises an inverse synthesis filter having an input to receive the acoustic source signal and an output to provide the target signal.

50. A transmitter according to claim 43, wherein the primary coder comprises an excitation generator having an input to receive the acoustic source signal, a first output to provide the primary coded signal and a second output provide the encoded information.

51. A transmitter according to claim 43, wherein the primary coder comprises at least one code book for providing the primary coded signal via feedback and successive adaptation controlled by a search unit.

52. A receiver for receiving and decoding encoded information from a transmission medium comprising:

a primary decoder having an input to receive an estimate of encoded information having been received from the transmission medium, and an output to provide a reconstructed primary coded signal being divided into reconstructed primary coded signal frames, which each comprises a first number of sample values;

an enhancement decoder having an input to receive a coded enhancement spectrum, and an output to provide a reconstructed enhancement spectrum being divided into reconstructed enhancement spectrum frames, which each comprises a second number of spectral coefficients;

an enhancement unit having a first input to receive the reconstructed enhancement spectrum, a second input to receive the reconstructed primary coded signal, and an output to provide an enhanced reconstructed primary coded signal; and a synthesis filter having an input to receive the enhanced reconstructed primary coded signal and an output to provide a reconstruction of the acoustic source signal, wherein:

the second number is larger than the first number; and the enhancement unit extends an incoming reconstructed primary coded signal frame to comprise the second number of sample values.

53. A receiver according to claim 52, wherein the enhancement unit produces an enhanced reconstructed primary coded signal frame by using spectral coefficients from one reconstructed enhancement spectrum frame and sample values from at least one reconstructed primary coded signal frame.

54. A receiver according to claim 52, wherein the second number is a power of the integer two.

55. A receiver according to claim 52, wherein the enhancement unit:

produces a reconstructed extended primary coded signal frame by extending a relevant reconstructed primary coded signal frame with sample values up to a total number of sample values being equal to the second number; and produces an enhanced reconstructed primary coded signal by multiplying a spectrum of the extended reconstructed extended primary coded signal frame with a relevant reconstructed enhancement spectrum frame.

56. A receiver according to claim 52, wherein the enhancement unit extends an incoming reconstructed primary coded signal frame by adding sample values from a previous reconstructed primary coded signal frame to the relevant reconstructed primary coded signal frame.

57. A receiver according to claim 52, wherein the enhancement unit extends an incoming reconstructed primary coded signal frame by adding sample values from a previous reconstructed enhanced primary coded signal frame to the relevant signal frame of the reconstructed enhanced primary coded signal.

58. A receiver according to claim 52, wherein the enhancement unit extends an incoming reconstructed primary coded signal frame by adding empty sample values to the relevant reconstructed primary coded signal frame.

59. A receiver according to claim 52, wherein the enhancement unit produces a reconstructed target signal frame by multiplying the extended reconstructed primary coded signal frame with a window-function comprising the second number of sample values and being centred over a relevant target signal frame.

60. A receiver according to claim 59, wherein the window-function is symmetric.

61. A receiver according to claim 59, wherein the window-function is asymmetric.

62. A receiver according to claim 59, wherein the window-function includes:

a first range comprising the first number of sample values for which the window-function has a constant magnitude, the first range corresponding to the relevant reconstructed primary coded signal frame; and a second range of sample values outside the first range for which the window-function has a gradually declining magnitude.

63. A receiver according to claim 52, wherein the primary decoder comprises an excitation generator having an input to receive the estimate of the encoded information and an output to provide the reconstructed primary coded signal.

64. A receiver according to claim 52, wherein the primary decoder comprises:

at least one input to receive the estimate of the encoded information; and at least one code book for providing the reconstructed primary coded signal on basis of the estimate of the encoded information.

65. A communication system for exchanging encoded acoustic source signals between a first node and a second node, the communication system comprising:

a transmitter according to claim 43;

a receiver; and a transmission medium for transporting encoded information from the transmitter to the receiver, wherein the receiver comprises:

a primary decoder having an input to receive an estimate of encoded information having been received from the transmission medium, and an output to provide a reconstructed primary coded signal being divided into reconstructed primary coded signal frames, which each comprises a first number of sample values;

an enhancement decoder having an input to receive a coded enhancement spectrum, and an output to provide a reconstructed enhancement spectrum being divided into reconstructed enhancement spectrum frames, which each comprises a second number of spectral coefficients;

an enhancement unit having a first input to receive the reconstructed enhancement spectrum, a second input to receive the reconstructed primary coded signal, and an output to provide an enhanced reconstructed primary coded signal; and a synthesis filter having an input to receive the enhanced reconstructed primary coded signal and an output to provide a reconstruction of the acoustic source signal, wherein:

the second number is larger than the first number; and the enhancement unit extends an incoming reconstructed primary coded signal frame to comprise the second number of sample values.

* * * * *